US012779534B2

(12) United States Patent
Delfosse et al.

(10) Patent No.: US 12,779,534 B2
(45) Date of Patent: Nov. 3, 2026

(54) METHOD FOR PRODUCING TURBOMACHINE DISKS

(71) Applicants: SAFRAN, Paris (FR); AUBERT & DUVAL, Paris (FR)

(72) Inventors: Jérome Delfosse, Moissy-Cramayel (FR); Jean-Michel Patrick Maurice Franchet, Moissy-Cramayel (FR)

(73) Assignees: SAFRAN, Paris (FR); Aubert & Duval, Paris (FR)

( * ) Notice: Subject to any disclaimer, the term of this patent is extended or adjusted under 35 U.S.C. 154(b) by 396 days.

(21) Appl. No.: 18/568,784

(22) PCT Filed: Jun. 9, 2022

(86) PCT No.: PCT/FR2022/051104
§ 371 (c)(1),
(2) Date: Dec. 8, 2023

(87) PCT Pub. No.: WO2022/258932
PCT Pub. Date: Dec. 15, 2022

(65) Prior Publication Data

US 2024/0269743 A1 Aug. 15, 2024

(30) Foreign Application Priority Data

Jun. 9, 2021 (FR) ..... 2106100

(51) Int. Cl.
*B22F 9/08* (2006.01)
*B22F 3/17* (2006.01)
*B22F 5/00* (2006.01)

(52) U.S. Cl.
CPC ..... *B22F 9/082* (2013.01); *B22F 3/17* (2013.01); *B22F 5/009* (2013.01);
(Continued)

(58) Field of Classification Search
CPC ..... B22F 9/082; B22F 2009/0824; B22F 2009/0836; B22F 2301/15; B22F 2998/10; B22F 5/009; B22F 1/05
See application file for complete search history.

(56) References Cited

U.S. PATENT DOCUMENTS

2020/0131604 A1 4/2020 Christofidou et al.

FOREIGN PATENT DOCUMENTS

| | | | |
|---|---|---|---|
| CN | 102615284 | A | 8/2012 |
| CN | 110586948 | A | 12/2019 |
| FR | 3054462 | A1 | 2/2018 |

OTHER PUBLICATIONS

International Search Report (with English translation) mailed Sep. 13, 2022, issued in corresponding International Application No. PCT/FR2022/051104, filed Jun. 9, 2022, 7 pages total.
(Continued)

*Primary Examiner* — Jessee R Roe
(74) *Attorney, Agent, or Firm* — Christensen O'Connor Johnson Kindness PLLC

(57) ABSTRACT

A method for manufacturing turbomachine disks is provided. The method includes: providing a nickel alloy powder; and shaping the powder to obtain a disk. Providing a powder can include: manufacturing a nickel alloy electrode by PAM-CHR; atomizing a nickel alloy by EIGA from the nickel alloy electrode, leading to a raw powder; and sifting the raw powder under inert atmosphere or under vacuum with a granulometric cut-off between 150 μm and 50 μm, leading to the nickel-based alloy powder. In some examples, the granulometric cut-off can be between 125 μm or 75 μm.

17 Claims, 3 Drawing Sheets

(52) U.S. Cl.
CPC ..... *B22F 2009/0824* (2013.01); *B22F 2009/0836* (2013.01); *B22F 2201/11* (2013.01); *B22F 2301/15* (2013.01); *B22F 2304/10* (2013.01)

(56) References Cited

OTHER PUBLICATIONS

Written Opinion (with English translation) mailed Sep. 13, 2022, issued in corresponding International Application No. PCT/FR2022/051104, filed Jun. 9, 2022, 13 pages total.
Jia et al; "Innovative technologies for powder metallurgy-based disk superalloys: Progress and proposal"; Chin. Phys. B.; 2016; pp. 026103-1-026103-7 (7 pages total); vol. 25; No. 2; Chinese Physical Society and IOP Publishing Ltd.

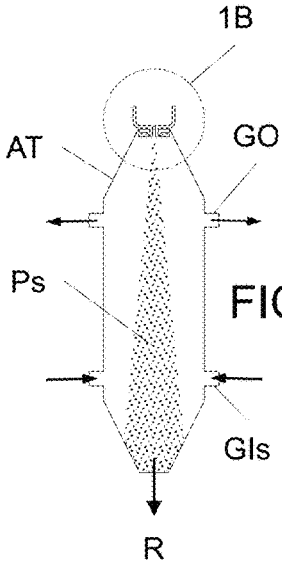
FIG. 1A
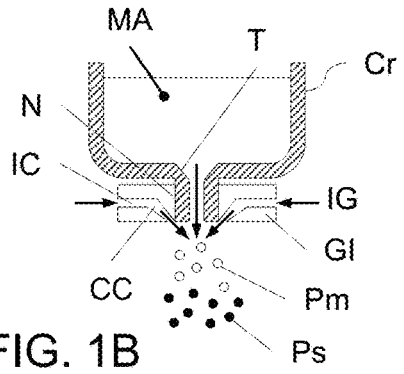
FIG. 1B
FIG. 5
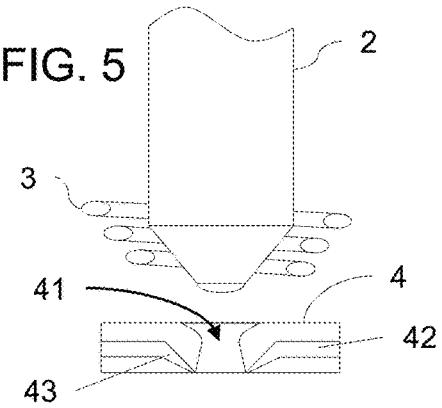
FIG. 6
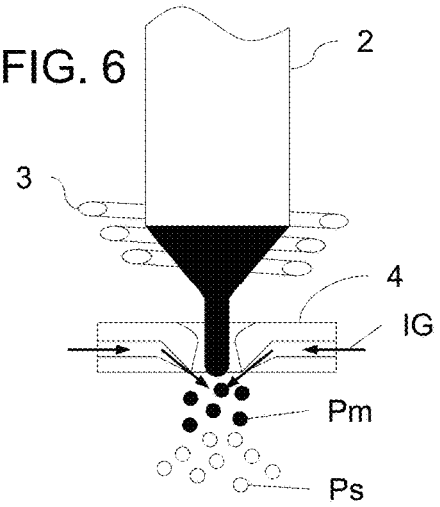
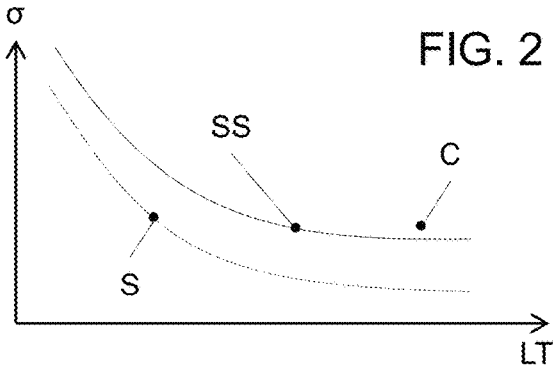
FIG. 2
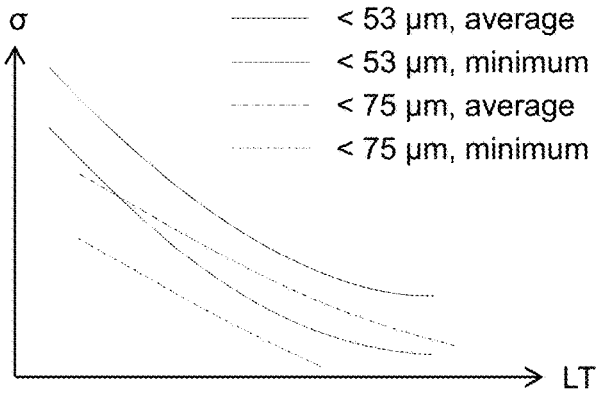
FIG. 3

METHOD FOR PRODUCING TURBOMACHINE DISKS

CROSS-REFERENCE TO RELATED APPLICATIONS

This application is a National Stage of International Application No. PCT/FR2022/051104, filed Jun. 9, 2022, which claims priority to French Patent Application No. 2106100, filed Jun. 9, 2021, the entire disclosures of which are hereby incorporated by reference in their entirety for all purposes.

TECHNICAL FIELD

The present disclosure relates to the technical field of turbomachine disks. The present disclosure relates more specifically to the field of methods for producing turbomachine disks.

BACKGROUND

Turbomachine disks are axially symmetric circular parts. These disks are subject to very high rotational speeds and large centrifugal forces. For performance reasons, the most stressed disks of the turboreactors subject to the highest temperatures are made of a nickel alloy. These alloys were first used in the manufacturing of military engines, and then also of latest generation civil engines, in particular high-power engines.

Today, the production method for this type of turbomachine disk is as follows:

- atomizing an alloy according to a method of vacuum induction-melting gas atomization (or VIGA) to obtain a raw powder;
- sifting the raw powder with a granulometric cut-off, generally <53 μm, and under vacuum or neutral atmosphere to obtain a sized powder;
- densifying the sized powder into a forging blank, comprising hot isostatic compaction and extrusion into a billet from which the forging blanks will be cut;
- isothermally forging the forging blank and heat treating the forged blank; and
- machining the forged blank to provide a disk.

As described in CN 102,615,284, it is possible to produce this type of turbomachine disk from a powder obtained by plasma atomization.

VIGA is shown by FIGS. 1A and 1B. FIG. 1A shows an atomization tower AT having a generally cylindrical shape over a majority of the length thereof and two frustoconical ends: one inlet end in upper position, and one outlet end in lower position. The atomization tower AT also comprises gas outlets GO in the upper part for the exhaust of gases and secondary gas inlets GIs in the lower part for the injection of secondary gas. The atomization tower AT is water-cooled through a cooling circuit arranged around it. The atomization tower AT further comprises a crucible Cr (on FIG. 1B) at the inlet end thereof for receiving alloy raw material. The alloy is heated to melting temperature to provide a molten alloy MA. The crucible Cr has a tundish T (also called flow funnel) on a lower surface thereof that is extended by a nozzle N through which the molten alloy MA flows by gravity. Under the crucible Cr, there is an inert gas injector GI. The injector GI comprises an injection crown IC extended by a convergence crown CC. The convergence crown CC guides the gas towards the thin stream of molten alloy MA which flows through the nozzle N and fragments it into molten alloy particles Pm which upon cooling form spherical solid particles Ps of the resulting raw powder. The solid particles Ps fall by gravity down along the atomization tower AT and are collected at the outlet thereof.

The disks resulting from this method have ceramic inclusions. These ceramic inclusions are rupture-initiating sites in the material. The proportion of ceramic inclusions in the final disk is relatively low and for most mechanical properties, the presence of a ceramic inclusion, in particular of less than 53 μm within a very strong homogeneous metal structure, has no substantial impact. This is for example the case for the mechanical properties in traction, creep and for crack propagation.

In contrast, the presence of these ceramic inclusions, even when very rare, has a large impact on the properties in fatigue and in particular Low Cycle Fatigue (LCF). FIG. 2 shows the lifetime LT in LCF of disks as a function of the load σ applied during the test. The solid line represents the average and the dotted line corresponds to the shortest lifetime observed.

It was observed that the minimum, dotted curve corresponds to the presence of ceramic inclusions at the surface of the disks S and that the average, solid curve corresponds to the presence of ceramic inclusions at the subsurface SS. Finally, it was also observed that the presence of ceramic inclusions in the core of the material of the disk C corresponds to an LCF curve close to the average curve.

The ceramic inclusions come from the step of manufacturing the raw powder and in particular from VIGA. In fact, in VIGA, the crucible Cr, the tundish T and the nozzle N are made of ceramic. The molten alloy MA is in more or less extended contact with the material of the crucible Cr, the tundish T and the nozzle N, interacts with them, and pulls loose ceramic particles therefrom by erosion. These ceramic particles are found in the raw powder. The composition of ceramic particles comprises for example mostly aluminium, magnesium, calcium, phosphorus, silicon and oxygen, in particular in the form of $Al_2O_3$—CaO or $Al_2O_3$—MgO ceramics.

Depending on their size and shape, the ceramic particles may pass through the sieve and be found in the final part. When these ceramic particles are found in the shaped, final powder, since they are refractory material, they are unimpacted by the hot operations of compacting, extruding, forging and heat treating during the manufacturing of disks. They are therefore found in the finished part and impact the mechanical properties thereof. Thus, it is important to be sure that there are no such particles in the disks put into operation.

Ultrasonic inspection makes it possible to identify the largest inclusions in the billets, and in particular the inclusions for which the largest dimension exceeds 200 μm and for which the length/width ratio is large, of about 4 to 5, which allows them to pass through the sieve used. If such a particle is identified, the affected section of the billet is eliminated.

An ultrasonic inspection is also preformed on the part after forging and heat treating in order to detect the presence of inclusions which led to initiation of clinks (thus cracks) during forging. The presence of these inclusions leads to discarding the part.

Further, for this type of material with ceramic inclusions, the minimum sizing curves used for sizing the parts must consider this point.

Additionally, the presence of a few but randomly distributed ceramic inclusions in the finished part requires a different sizing approach from the approach used for a conventional metal part, i.e. with a homogeneous structure: a probabilistic approach has to be used.

Indeed, for a conventional metal material, sizing is done by using sizing curves established from trials on test specimens sampled on the finished parts. The microstructure, which is homogeneous, is globally equivalent from one test specimen to another. Thus, the sampled test specimen is representative of the structure of the whole part.

For alloys obtained by VIGA, the results on test specimens (therefore the sizing curves) are only representative of areas of the part having a test volume equivalent to that of the test specimens due to the presence of ceramic inclusions randomly distributed in the finished part. This is the reason, for these alloys, why the fatigue tests are done on larger size test specimens, for example test specimens having a useful volume of about 5 to 10 times greater than that of the fatigue test specimens used.

However, in real parts, some areas are relatively massive and therefore involve significantly larger volumes than that of the test specimens, even the largest used. These part areas are therefore not covered by this sizing network on large test specimens; it is necessary to use a complex probabilistic sizing technique.

This technique takes into account the massiveness of the considered zone, the cleanliness curve of the alloy (meaning, in the case of alloys prepared by VIGA, the number of ceramic particles per kilogram), the size of the critical defect represented by a ceramic inclusion, the probability of the presence of the critical defect. More concretely, the size of the critical defect is determined for each characteristic area of the disk based on the desired lifetime, information about the presence of cracks in the finished parts and measurements done on fatigue test specimens. With the size of the critical defect and the cleanliness curve, the probability of the presence of the critical defect can be calculated for finally determining the minimum dimensions of the part.

According to this manufacturing method, the only parameter which the manufacturer can work with for optimizing the lifetime under fatigue of such alloys is the size of the ceramic inclusions. Thus, in the 2000s, sifting with a <53 μm granulometric cut-off replaced the conventional sifting of the time which used a <75 μm granulometric cut-off. The lifetime of the parts was extended with an improvement of a factor of 3 as shown in FIG. 3 which is a graph showing the lifetime (LT) as a function of the applied stress (a) for both granulometric cut-offs: <53 μm and <75 μm. The average curve and the minimum curve are given for both granulometric cut-offs.

Thus, in the method currently used for manufacturing disks, the step of sifting is important because it makes it possible to reduce the quantity and size of ceramic particles in the powder which will be shaped and in the end, it makes it possible to increase the lifetime.

Further, a <53 μm granulometric cut-off leads to a ceramic particle frequency of between 5 and 40 particles per kilogram of powder.

However, the use of a granulometric cut-off that low also leads to discarding a substantial quantity of powder produced by VIGA (between 30 and 50% by weight).

SUMMARY

An objective of the present disclosure is to remedy at least one drawback of the prior art described above. In particular, an objective of the present disclosure is to improve the lifetime of turbomachine disks exposed to the highest temperatures.

To this aim, the present disclosure provides a method for manufacturing turbomachine disks. The method comprises:

providing a nickel alloy powder;

shaping the powder to obtain a disk;

characterized in that providing a powder comprises:

manufacturing a nickel alloy electrode by plasma arc melting cold hearth refining, PAM-CHR, atomizing a nickel alloy by electrode induction melting gas atomization, EIGA, from the nickel alloy electrode, leading to a raw powder; and sifting the raw powder under neutral atmosphere or under vacuum with a granulometric cut-off of between 150 μm and 50 μm, for example 125 μm or 75 μm, leading to the nickel alloy powder.

CN 110,586,948 and US 2020/131604 describe a method for manufacturing a turbomachine disk from a powder obtained by EIGA.

The inventors, however, observed that obtaining the nickel alloy powder by EIGA was not sufficient for eliminating the presence of ceramic inclusions in this powder. Indeed, as taught in "*Innovative technology for powder metallurgy-based disk superalloys: Progress and proposal*" Chin. Phys. B, vol. 25, No. 2 (2016), EIGA may prevent, but not eliminate, the presence of ceramic inclusions in this powder.

Now, as indicated above, the presence of these ceramic inclusions, even when very rare, has a large impact on the fatigue properties.

Advantageously, the combination of the manufacturing the nickel alloy electrode by PAM-CHR and atomizing the nickel alloy by EIGA makes it possible to eliminate the presence of the ceramic inclusions in the resulting nickel alloy powder.

Further optional and nonlimiting features are as follows.

During PAM-CHR refining, the nickel alloy may be melted in a water-cooled copper crucible before being melted in a copper molder ring crucible.

EIGA may comprise:

arranging the electrode having a longitudinal axis such that the longitudinal axis of the electrode is vertical;

contactlessly heating the lowest end of the electrode leading to a thin stream of molten alloy flowing by gravity through a nozzle; and injecting, at the outlet of the nozzle, an inert gas directed towards and around the thin stream of molten alloy resulting in the atomization of the thin stream of alloy.

The inert gas may be argon.

Sifting may be carried out with a granulometric cut-off of between 140 μm and 60 μm or between 130 μm and 70 μm.

Shaping may comprise:

hot densifying the powder into a forging blank;

manufacturing the disk by isothermally forging, heat treating and machining the blank.

Densifying may comprise:

placing the powder under vacuum in a hermetically sealed container;

hot compacting the container;

extruding the compacted container resulting in a cylindrical bar having an outer layer made of the material of the container and a cylindrical core made of nickel alloy; and eliminating of the outer layer;

cutting the cylindrical core into forging blanks.

DESCRIPTION OF THE DRAWINGS

The foregoing aspects and many of the attendant advantages of the claimed subject matter will become more readily appreciated as the same become better understood by reference to the following detailed description, when taken in conjunction with the accompanying drawings, wherein:

FIG. 1A is a drawing of a VIGA atomization tower.

FIG. 1B is an enlargement at the crucible of the VIGA atomization tower of FIG. 1A.

FIG. 2 is a graph showing the lifetime (LT) of the test specimen of nickel alloy prepared from a powder obtained by VIGA as a function of the stress (a) applied during testing. The average LCF curve and the minimum LCF curve are shown.

FIG. 3 is a graph showing the lifetime (LT) of the test specimen of nickel alloy prepared from a powder obtained by VIGA with sifting as a function of the stress (a) applied during testing. The average LCF curve and the minimum LCF curve are given for two granulometric cut-offs used, <53 μm and <75 μm.

FIG. 5 is a drawing of an upper part of an EIGA atomization tower where an electrode is melted, before the electrode melts.

FIG. 6 is the same drawing as FIG. 5 during melting of the electrode.

DETAILED DESCRIPTION

The detailed description set forth above in connection with the appended drawings, where like numerals reference like elements, are intended as a description of various embodiments of the present disclosure and are not intended to represent the only embodiments. Each embodiment described in this disclosure is provided merely as an example or illustration and should not be construed as preferred or advantageous over other embodiments. The illustrative examples provided herein are not intended to be exhaustive or to limit the disclosure to the precise forms disclosed.

A method for manufacturing turbomachine disks according to the present disclosure is described below with reference to FIGS. 4 to 11.

Figure 4:
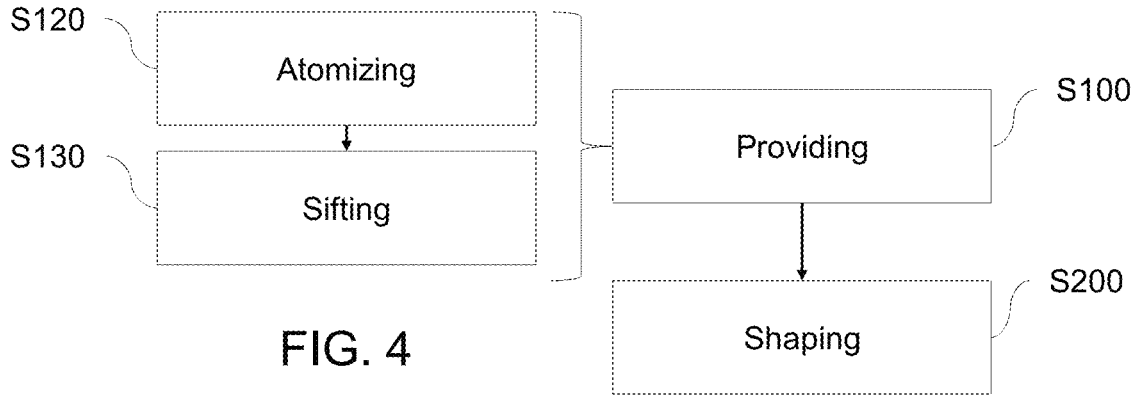
FIG. 4 is a chart schematically showing an exemplary method for manufacturing turbomachine disks according to the present disclosure.

Such a method comprises providing S100 a powder of nickel alloy and shaping S200 the powder into a disk (FIG. 4).

Figure 7:
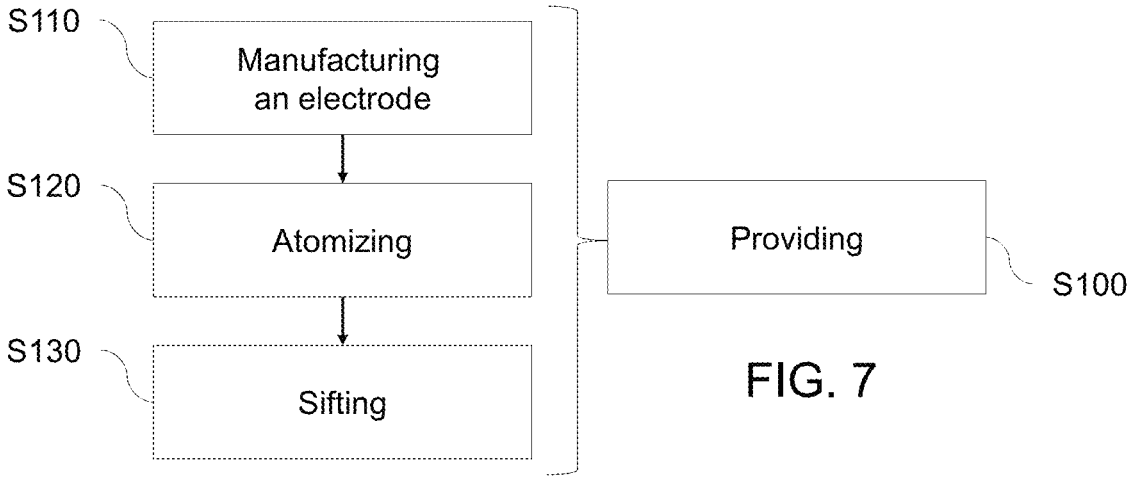
FIG. 7 is a chart schematically showing the steps for providing the powder according to an exemplary method for manufacturing turbomachine disks according to the present disclosure.
Figure 8:
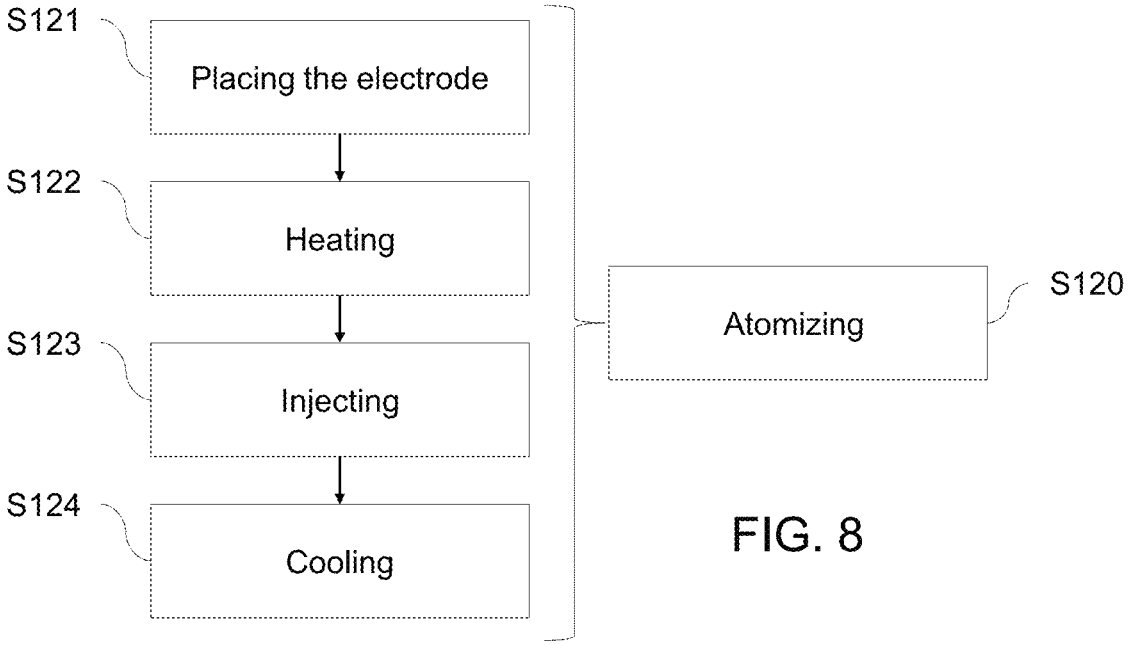
FIG. 8 is a chart schematically showing the steps for atomizing a nickel alloy according to an exemplary method for manufacturing turbomachine disks according to the present disclosure.

Obtaining S100 the powder comprises atomizing S120 a nickel alloy through Electrode Induction-Melting Gas Atomization (also called EIGA) and sifting S130 the raw powder under vacuum or under neutral atmosphere with a granulometric cut-off of between 150 μm and 50 μm (FIGS. 4 and 7). The neutral atmosphere may be an argon atmosphere.

EIGA (FIG. 8) is performed with a nickel alloy electrode 2 with a longitudinal axis. EIGA results in a raw powder. Atomizing S120 may comprise placing S121 the electrode 2 such that the longitudinal axis of the electrode is vertical, contactlessly heating S122 the lowest end of the electrode 2 resulting in a thin stream of molten alloy flowing by gravity through a nozzle and injecting S123, at the outlet of the nozzle, an inert gas directed towards and around the thin stream of molten alloy resulting in the atomization of the thin stream of alloy. Thus, there is no contact between the electrode and any other element during heating.

Contactlessly heating S122 may be carried out through induction. Heating S122 is performed until the electrode material melts and a thin stream of molten alloy flows from the lower end of the electrode.

Injecting S123 the inert gas towards the thin stream of molten alloy cuts the thin stream of molten alloy into molten alloy particles Pm. The injected inert gas may be argon.

Atomizing S120 may comprise cooling S124 the molten alloy particles Pm to obtain solid particles Ps. Cooling S124 may be performed passively, meaning by contacting the molten alloy particles Pm with the surrounding atmosphere, the molten alloy particles Pm exchanging heat with this atmosphere. Cooling S124 may also be active, for example by injecting an inert gas with a temperature lower than the melting temperature of the alloy. Active cooling S124 may also be performed by cooling the atomization tower in which particles are produced, for example using a cooling circuit surrounding the atomization tower.

FIG. 5 shows the upper part of an EIGA atomization tower. The remainder of the tower (lower part) is similar to the VIGA atomization tower of FIG. 1A. Thus, this lower part will not be described in more detail here.

EIGA requires an electrode 2 of the desired nickel alloy, a contactless heater, for example an induction heater 3, and an inert gas injector 4. The contactless heater comprises a space for receiving the lower end of the electrode 2. In the case of an induction heater 3, this latter comprises coils around a receiving space. The injector 4 comprises a central orifice 41 serving as a nozzle with an inlet at its upper part and an outlet at its lower part. The injector 4 also comprises an injection crown 42 and a convergence crown 43 for bringing the gas towards the outlet of the injector 4. Further, the injector 4 may be conFIGUREd to generate a swirling flow of the inert gas. During contactless heating, the lower end of the electrode 2 is induction heated by the coils of the induction heater 3 until the electrode material melts. From this moment (see FIG. 6), a thin stream of molten alloy flows through the orifice 41 of the injector 4. Inert gas is injected by the injection crown 42 and redirected towards the outlet by the convergence crown 43. The inert gas jet cuts the thin stream of molten alloy and atomizes it to form molten particles Pm which solidify into falling solid particles Ps. It is worth observing once again that the bottom end of the electrode 2 is heated without contact with another element and that the thin stream of molten alloy also flows through the orifice 41 of the injector 4 without contact with the walls of the orifice 41. Thus, unlike VIGA, there is no risk of pulling ceramic particles free with EIGA.

Replacement of VIGA by EIGA is not an obvious choice. In fact, VIGA allows a very precise control of the temperature to which the alloy is heated and in particular allows overheating this alloy because this latter is contained in a crucible during heating. The overheating of the alloy has the advantage of allowing production of powders that are very fine compared to a heating temperature equal to the melting temperature. This overheating is not as easily controllable with EIGA because the alloy flows in the form of a thin stream as soon as it reaches its melting temperature. Further, VIGA makes it possible to control the thickness of the stream flowing from the crucible by controlling the opening of the crucible nozzle. This control is not possible with EIGA.

Also, EIGA uses an electrode which must be fabricated. This then adds an additional step in the manufacturing process of the powder, whereas VIGA simply makes it possible to gather the ingredients in the crucible before heating.

The electrode used in EIGA is made by plasma arc melting with cold hearth refining(also known under the acronym PAM-CHR).

PAM-CHR may be carried out in a cold-crucible refining furnace. In that kind of furnace, the metal is first melted in a water-cooled copper crucible before flowing into a copper molder ring. Copper is not reactive with nickel alloys; this eliminates any contamination of the electrode by ceramic inclusions.

Thus, providing S100 the powder comprises manufacturing S110 an electrode 2 such as described above (FIG. 7).

The granulometric cut-off may be comprised between 140 μm and 60 μm or even between 130 μm 70 μm, for example 125 μm, 75 μm or 53 μm. Sifting S130 results in a nickel alloy powder which will be used for shaping S200.

The use of a <53 μm granulometric cut-off in VIGA was due to the intent to improve the mechanical properties of the manufactured parts which were reduced by the presence of ceramic inclusions in the material. The present authors, when looking for a solution for even further improving the mechanical properties, identified the combination of PAM-CHR and EIGA as a solution for manufacturing the nickel alloy powder with a greatly reduced or even nonexistent ceramic inclusion contamination level compared to VIGA. They next had the idea of raising the granulometric cut-off up to 75 μm, even 125 μm or even 150 μm. The use of a higher granulometric cut-off leads to an improvement in the atomization yield; indeed, less raw powder needs to be discarded, or otherwise expressed, a larger portion of raw powder may be used for manufacturing the disks.

Another indirect advantage relates to the grain size of the finished parts. Now, it is well known that the creep properties increase with the grain size. During the manufacturing of the disks, the nickel alloy is treated at temperatures over γ' solvus. At these temperatures, the primary γ' grains, the role of which is to block the grain joints, are dissolved and the grains grow. However, in the case of powders, the growth of the grain remains limited to the size of the particles of the initial powder. In fact, the growth of the grains is blocked by the prior particle boundaries of the particles (also known as PPB) which are thin oxide layers at the surface of the powder particles and which limit the grain size to the initial size of the powder particles.

By increasing the granulometric cut-off, the powder particle size is increased which makes it possible to increase the grain size in the finished part thereby improving the creep properties thereof.

The absence of ceramic inclusions makes it possible to dispense with the probabilistic approach to the sizing of the parts and return to a conventional approach in which the sampled test specimen is representative of the material of the entire part.

Figure 9:
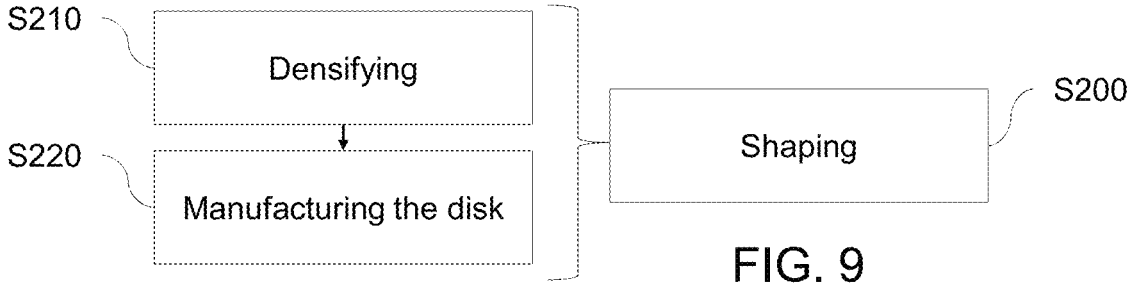
FIG. 9 is a chart schematically showing the steps of shaping the powder according to an exemplary method for manufacturing turbomachine disks according to the present disclosure.

Shaping S200 may comprise hot densifying S210 the sifted powder into a forging blank and manufacturing S220 the disk (FIG. 9).

Figure 10:
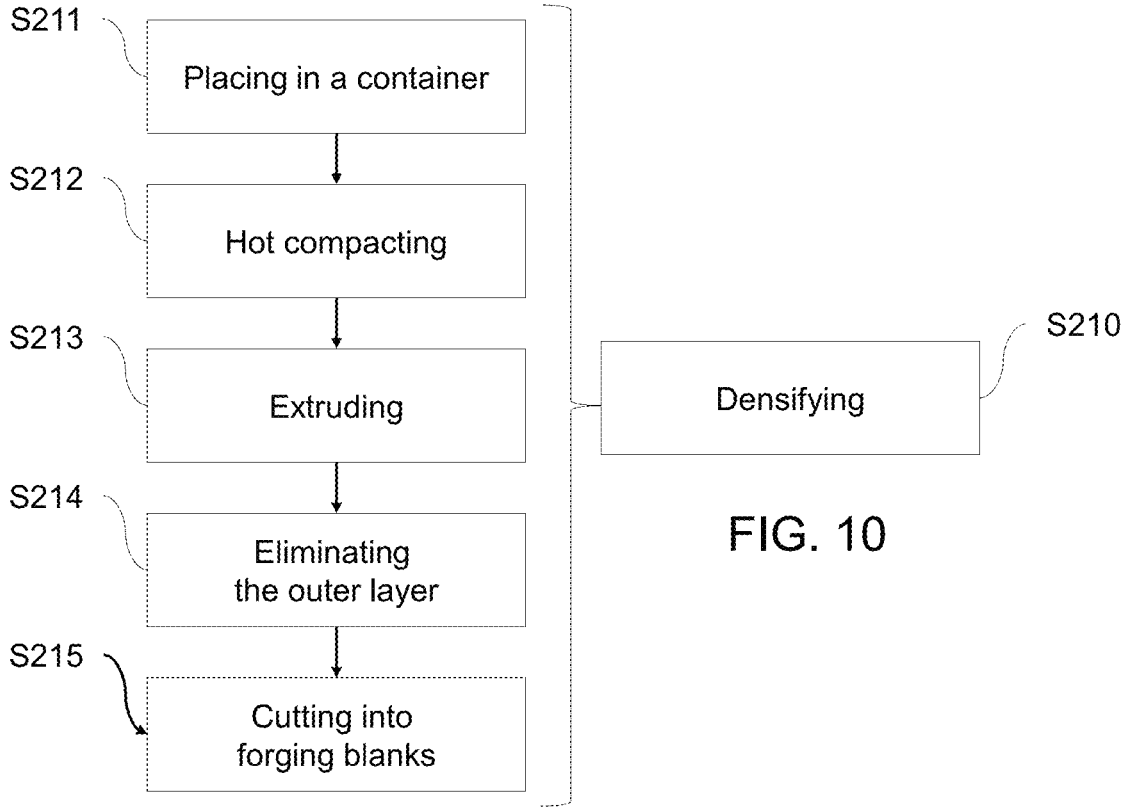
FIG. 10 is a chart schematically showing the steps for densifying the powder according to an exemplary method for manufacturing turbomachine disks according to the present disclosure.

Densifying S210 may comprise placing S211 the sifted powder under vacuum in a hermetically sealed container, hot compacting S212 the container, extruding S213 the compacted container resulting in a cylindrical bar having an outer layer made of the material of the container and a cylindrical core made of nickel alloy, and eliminating S214 the outer layer, for example by machining, and cutting S215 the cylindrical core into forging blanks (FIG. 10).

Figure 11:
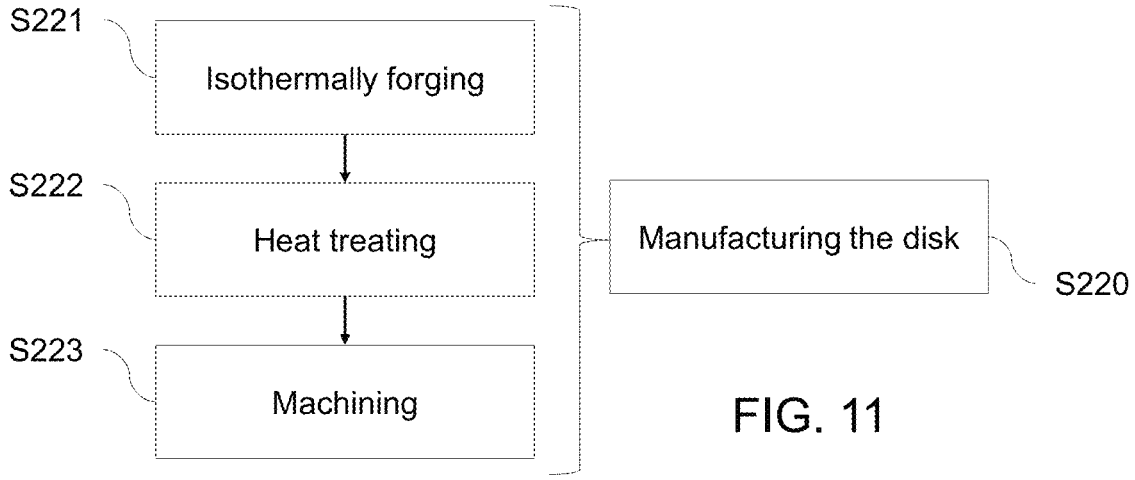
FIG. 11 is a chart schematically showing the steps for manufacturing a disk from a forging blank according to an exemplary method for manufacturing turbomachine disks according to the present disclosure.

Manufacturing S220 the disk may comprise isothermally forging S221 the blank, heat treating S222 and machining S223 the disk (FIG. 11). Isothermally forging may comprise transforming the cylindrical blank into a disk, of more or less complex shape, by the use of matrices; the cylindrical blank and the matrices are at the same temperature. Isothermally forging, as long as the nickel alloys are concerned, makes it possible to avoid surface cracks which form during contact of the cylindrical blank with cold matrices.

Heat treating may comprise solution annealing at high temperature followed by controlled cooling and a tempering treatment at a lower temperature for a longer time. With a combination of temperature, time and cooling speeds, these treatments make it possible to guide the microstructure in terms of grain size and size distribution of the hardening γ' phase to obtain the required mechanical properties.

Machining provides the part with its final geometry according to the plan.

In the foregoing description, specific details are set forth to provide a thorough understanding of exemplary embodiments of the present disclosure. It will be apparent to one skilled in the art, however, that the embodiments disclosed herein may be practiced without embodying all of the specific details. In some instances, well-known process steps have not been described in detail in order not to unnecessarily obscure various aspects of the present disclosure. Further, it will be appreciated that embodiments of the present disclosure may employ any combination of features described herein.

The present application may reference quantities and numbers. Unless specifically stated, such quantities and numbers are not to be considered restrictive, but exemplary of the possible quantities or numbers associated with the present application. Also in this regard, the present application may use the term "plurality" to reference a quantity or number. In this regard, the term "plurality" is meant to be any number that is more than one, for example, two, three, four, five, etc. The terms "about," "approximately," "near," etc., mean plus or minus 10% of the stated value. For the purposes of the present disclosure, the phrase "at least one of A and B" is equivalent to "A and/or B" or vice versa, namely "A" alone, "B" alone or "A and B.". Similarly, the phrase "at least one of A, B, and C," for example, means (A), (B), (C), (A and B), (A and C), (B and C), or (A, B, and C), including all further possible permutations when greater than three elements are listed.

It should be noted that for purposes of this disclosure, terminology such as "upper," "lower," "vertical," "horizontal," "fore," "aft," "inner," "outer," "front," "rear," etc., should be construed as descriptive and not limiting the scope of the claimed subject matter. Further, the use of "including," "comprising," or "having" and variations thereof herein is meant to encompass the items listed thereafter and equivalents thereof as well as additional items. Unless limited otherwise, the terms "connected," "coupled," and "mounted" and variations thereof herein are used broadly and encompass direct and indirect connections, couplings, and mountings.

Throughout this specification, terms of art may be used. These terms are to take on their ordinary meaning in the art from which they come, unless specifically defined herein or the context of their use would clearly suggest otherwise.

The principles, representative embodiments, and modes of operation of the present disclosure have been described in the foregoing description. However, aspects of the present disclosure, which are intended to be protected, are not to be construed as limited to the particular embodiments disclosed. Further, the embodiments described herein are to be regarded as illustrative rather than restrictive. It will be appreciated that variations and changes may be made by others, and equivalents employed, without departing from the spirit of the present disclosure. Accordingly, it is expressly intended that all such variations, changes, and equivalents fall within the spirit and scope of the present disclosure as claimed.

The invention claimed is:

1. A method for manufacturing turbomachine disks, comprising:
- providing a nickel alloy powder;
- shaping the powder to obtain a disk;
- wherein providing the powder comprises:
  - manufacturing a nickel alloy electrode by plasma arc melting cold hearth refining, PAM-CHR;
  - atomizing a nickel alloy by electrode induction melting gas atomization, EIGA, from the nickel alloy electrode, leading to a raw powder; and
  - sifting the raw powder under inert atmosphere or under vacuum with a granulometric cut-off between 150 μm and 50 μm leading to the nickel alloy powder,
  - wherein during PAM-CHR, the nickel alloy is melted in a water-cooled copper crucible before being melted in a copper molder ring crucible.

2. The method of claim 1, wherein EIGA comprises:
- arranging the electrode having a longitudinal axis such that the longitudinal axis of the electrode is vertical;
- contactlessly heating the lowest end of the electrode leading to a thin stream of molten alloy flowing by gravity through a nozzle; and
- injecting, at the outlet of the nozzle, an inert gas directed towards and around the thin stream of molten alloy resulting in the atomization of the thin stream of alloy.

3. The method of claim 2, wherein the inert gas is argon.

4. The method of claim 1, wherein the sifting is carried out with a granulometric cut-off between 125 μm and 75 μm.

5. The method of claim 1, wherein shaping comprises:
- hot densifying the powder into a forging blank;
- manufacturing the disk by isothermally forging, heat treating, and machining the blank.

6. The method of claim 5, wherein hot densifying comprises
- placing the powder under vacuum in a hermetically sealed container;
- hot compacting of the container;
- extruding the compacted container resulting in a cylindrical bar having an outer layer made of the material of the container and a cylindrical core made of nickel-based alloy; and
- eliminating of the outer layer; and
- cutting of the cylindrical core into forging blank.

7. A method for manufacturing turbomachine disks, comprising:
- providing a nickel alloy powder;
- shaping the powder to obtain a disk,
- wherein providing the powder comprises:
  - manufacturing a nickel alloy electrode by plasma arc melting cold hearth refining, PAM-CHR;
  - atomizing a nickel alloy by electrode induction melting gas atomization, EIGA, from the nickel alloy electrode, leading to a raw powder; and
  - sifting the raw powder under inert atmosphere or under vacuum with a granulometric cut-off between 150 μm and 50 μm leading to the nickel alloy powder,
  - wherein EIGA comprises:
    - arranging the electrode having a longitudinal axis such that the longitudinal axis of the electrode is vertical;
    - contactlessly heating the lowest end of the electrode leading to a thin stream of molten alloy flowing by gravity through a nozzle; and
    - injecting, at the outlet of the nozzle, an inert gas directed towards and around the thin stream of molten alloy resulting in the atomization of the thin stream of alloy.

8. The method of claim 7, wherein during PAM-CHR, the nickel alloy is melted in a water-cooled copper crucible before being melted in a copper molder ring crucible.

9. The method of claim 7, wherein the inert gas is argon.

10. The method of claim 7, wherein the sifting is carried out with a granulometric cut-off between 140 μm and 60 μm, between 130 μm and 70 μm, or between 125 μm and 75 μm.

11. The method of claim 7, wherein shaping comprises:
- hot densifying the powder into a forging blank;
- manufacturing the disk by isothermally forging, heat treating, and machining the blank.

12. The method of claim 11, wherein hot densifying comprises:
- placing the powder under vacuum in a hermetically sealed container;
- hot compacting of the container;
- extruding the compacted container resulting in a cylindrical bar having an outer layer made of the material of the container and a cylindrical core made of nickel-based alloy;
- eliminating of the outer layer; and
- cutting of the cylindrical core into forging blank.

13. A method for manufacturing turbomachine disks, comprising:
- providing a nickel alloy powder;
- shaping the powder to obtain a disk,
- wherein providing the powder comprises:
  - manufacturing a nickel alloy electrode by plasma arc melting cold hearth refining, PAM-CHR;
  - atomizing a nickel alloy by electrode induction melting gas atomization, EIGA, from the nickel alloy electrode, leading to a raw powder; and
  - sifting the raw powder under inert atmosphere or under vacuum with a granulometric cut-off between 150 μm and 50 μm leading to the nickel alloy powder,
- wherein shaping comprises:
  - hot densifying the powder into a forging blank; and
  - manufacturing the disk by isothermally forging, heat treating, and machining the blank, and
- wherein hot densifying comprises:
  - placing the powder under vacuum in a hermetically sealed container;
  - hot compacting of the container;

extruding the compacted container resulting in a cylindrical bar having an outer layer made of the material of the container and a cylindrical core made of nickel-based alloy;

eliminating of the outer layer; and cutting of the cylindrical core into forging blank.

14. The method of claim 13, wherein during PAM-CHR, the nickel alloy is melted in a water-cooled copper crucible before being melted in a copper molder ring crucible.

15. The method of claim 13, wherein EIGA comprises:

arranging the electrode having a longitudinal axis such that the longitudinal axis of the electrode is vertical;

contactlessly heating the lowest end of the electrode leading to a thin stream of molten alloy flowing by gravity through a nozzle; and injecting, at the outlet of the nozzle, an inert gas directed towards and around the thin stream of molten alloy resulting in the atomization of the thin stream of alloy.

16. The method of claim 15, wherein the inert gas is argon.

17. The method of claim 13, wherein the sifting is carried out with a granulometric cut-off between 125 μm and 75 μm.

* * * * *